United States Patent [19]

Broderick et al.

[11] Patent Number: 4,792,241

[45] Date of Patent: Dec. 20, 1988

[54] DUAL DRAW TAPE BAG AND METHOD OF MANUFACTURE

[75] Inventors: Kevin Broderick, Victor; Vernon C. Catchman, Palmyra; Fox J. Herrington, Holcomb; Shirley K. Johnston, Sodus Point, all of N.Y.; Robert H. Olson, Beaufort, S.C.; Donald Stell, Palmyra, N.Y.

[73] Assignee: Mobil Oil Corporation, New York, N.Y.

[21] Appl. No.: 100,648

[22] Filed: Sep. 24, 1987

[51] Int. Cl.[4] ..... B65D 33/28

[52] U.S. Cl. ..... 383/75; 383/72; 493/225

[58] Field of Search ..... 383/75, 71, 72, 76, 383/92, 908; 493/203, 211, 215, 225

[56] References Cited

U.S. PATENT DOCUMENTS

| | | | |
|---|---|---|---|
| 463,597 | 11/1891 | Cussen | 383/75 |
| 467,108 | 1/1892 | Cussen . | |
| 835,673 | 11/1906 | Fross . | |
| 1,092,955 | 4/1914 | Sharer . | |
| 3,010,640 | 11/1961 | Kugler . | |
| 3,029,853 | 4/1962 | Piazze . | |
| 3,506,048 | 4/1970 | Jortikka . | |
| 3,547,341 | 12/1970 | Kirkpatrick . | |
| 3,552,639 | 1/1971 | Meyer | 383/75 |
| 3,738,568 | 6/1973 | Ruda . | |
| 4,260,003 | 4/1981 | Hendrickson | 383/72 |
| 4,558,463 | 12/1985 | Boyd . | |
| 4,624,654 | 11/1986 | Boyd et al. . | |
| 4,628,536 | 12/1986 | Herrington | 383/75 |

FOREIGN PATENT DOCUMENTS

| | | | |
|---|---|---|---|
| 1183880 | 7/1959 | France | 383/75 |
| 1236831 | 6/1960 | France | 383/72 |
| 1125363 | 8/1968 | United Kingdom . | |

*Primary Examiner*—Willis Little

*Attorney, Agent, or Firm*—Alexander J. McKillop; Michael G. Gilman; Charles J. Speciale

[57] ABSTRACT

A dual draw tape bag has a front wall and back wall of flexible sheet material joined to each other along edges of the bag. Tubular channels extend along opposed transverse top edges of the front and back walls. The channels define an open mouth for the bag. Each of the channels has openings at the opposite ends of the top edges of the bag. A pair of tapes extend through each of the chanels. One of the ends of each of the tapes is attached to the opposite side edges of the bag beneath the openings in the channels and the other ends of the tapes extend through the respective openings at the other end of the channels so that the tapes cross in the channels, whereby when the tapes are pulled, the top of the bag is drawn tightly together.

6 Claims, 2 Drawing Sheets

DUAL DRAW TAPE BAG AND METHOD OF MANUFACTURE

FIELD OF THE INVENTION

The invention relates to the manufacture of flexible bags and particularly to the manufacture of draw tape bags from thermoplastic films having a tight closure.

BACKGROUND OF THE INVENTION

Bags made of plastic film such as thin polyethylene film have been used in various sizes Small bags are used in the packaging of sandwiches and the like; larger bags are used for shopping bags and even larger bags are used for containing trash. The present invention is particularly related to draw band bags having a tight closure.

A particularly advantageous closure for such bags includes a draw band or tape constructed from the same polyethylene material. Draw tape bags of this type have been know for several years and are described in various patents such as, for example, U.S. Pat. No. 3,029,853—Piazze. Bags of this type are formed by two pliable plastic sheets joined to one another on three sides and open at a fourth. A tubular hem is provided at the open end of each sheet and contains a pliable thermoplastic strip. A hole intermediate the ends of each hem exposes the strip in the hems allowing them to be pulled through the openings and used as a handle while simultaneously closing the open mouth of the bag. A similar type bag is disclosed in U.S. Pat. No. 4,624,654—Boyd et al. The draw tapes in the bags disclosed in these patents are at the same level in both hems of the bag. Draw tape bags using two tapes at different parallel levels in the bags are disclosed in U.S. Pat. Nos. 3,547,341—Kirkpatrick and 3,738,568—Ruda. In both of these patents the openings for pulling the draw tapes are at the opposite edges of the bag.

RELATED APPLICATION

The present invention is related to our application entitled "Draw Tape Bag with Two Single Dow Tapes" and Method of Manufacture Ser. No. 100,649 incorporated herein by reference thereto and concurrently filed herewith.

It is an object of the present invention to provide a draw tape bag having dual tapes, each of which is pulled from a different edge of the bag. The tapes are crossed within each bag hem so the mouth of the bag is drawn tightly closed.

SUMMARY OF THE INVENTION

In accordance with the present invention, there is provided a dual draw tape bag having a front wall and a back wall of flexible sheet material joined to each other along the edges of the bag. Tubular channels extend along opposed top edges of the front wall and the back wall, respectively, the channels defining an open mouth for the bag and each of the channels having openings at the opposite ends of the top edges of the bag. A pair of tapes extend through each of the channels, one of the ends of each of the tapes being attached to the opposite side edges of the bag beneath the openings in the channels and the other ends of the tapes extending through the respective openings at the other ends of the channels so that the tapes in the channels cross whereby when the tapes are pulled the top of the bag is drawn tightly together.

In accordance with a further aspect of the invention the ends of the tapes extending through the respective openings are joined together to form a pair of annular draw tapes for closing the top of the bag.

In accordance with another aspect of the invention the flexible sheet material and the tapes comprise thermoplastic film wherein the side edges of the bags and the ends of the tapes are joined together by heat seals.

Further in accordance with the invention there is provided a method of making a dual draw tape bag comprising the steps of providing a continuous length of flexible thermoplastic bag material folded once longitudinally having a longitudinal fold edge and two adjoining material layers each with a longitudinal free edge opposite the longitudinal fold edge to form a front wall and a back wall of the bag. The method further includes folding the two longitudinal free edges respectively against the adjoining layers to provide a pair of longitudinal hems of double layer thickness opposite the longitudinal fold edge and providing a hole in each hem at predetermined intervals corresponding to the width of the bags to expose subsequently inserted draw tape. The method further includes inserting a pair of continuous strip thermoplastic draw tapes in crossed relation into each hem the tapes being oscillated up and down for alternate bags so that one end of one tape in the pair in one hem is below the hole at one side of the bag and the other end is in line with the hole at the other side of the bag and the end of the second tape in the pair is in line with the hole at the one side of the bag and below the hole at the other side of the bag. The method further includes longitudinally joining together the double layer thickness of each hem to form a channel along the longitudinal top edges of the front wall and the back wall opposite the longitudinal fold each channel containing a pair of continuous crossed draw tapes and transversely sealing and severing the flexible bag material and crossed draw tapes at the predetermined intervals along the length of the flexible bag material to separate individual bags from the continuous length of flexible thermoplastic bag material.

The foregoing and other objects, features and advantages of the invention will be better understood from the following more detailed description and appended claims.

DESCRIPTION OF THE PREFERRED EMBODIMENT

The plastic draw tape bags of the present invention may be made from either high density polyethylene or from linear low density polyethylene or equivalent plastic materials. In the preferred form of the invention the bags are formed from a tube of polyethylene which is oriented in the direction of extrusion. Such materials for plastic bags are disclosed in U.S. Pat. No. 4,558,463—Boyd. Apparatus suitable for manufacturing draw tape bags of the present invention is disclosed in U.S. Pat. No. 4,624,654—Boyd et al and the disclosure therein is incorporated herein by reference thereto.

Figure 1:
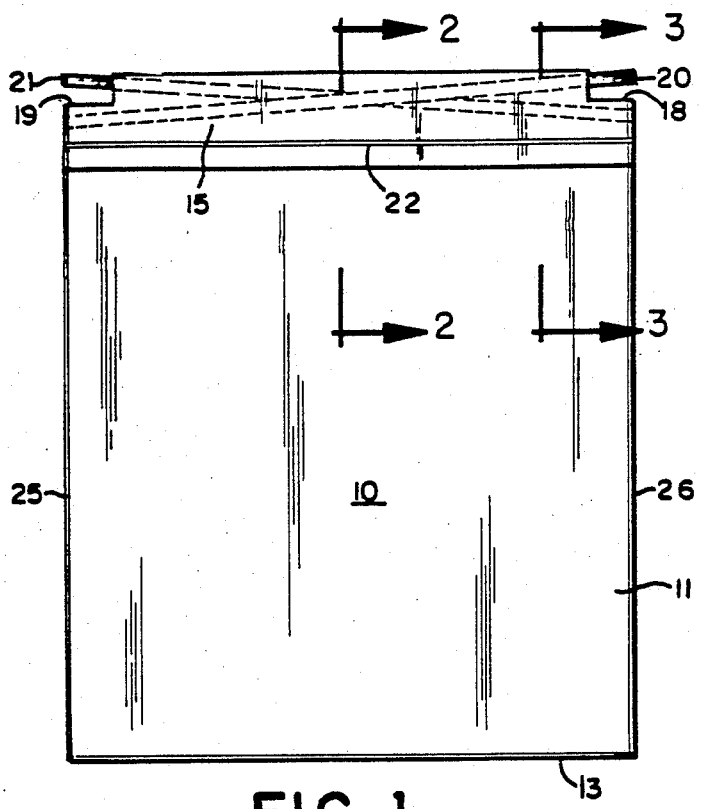
FIG. 1 is an elevational view of a dual draw tape bag embodying the present invention.
Figure 2:
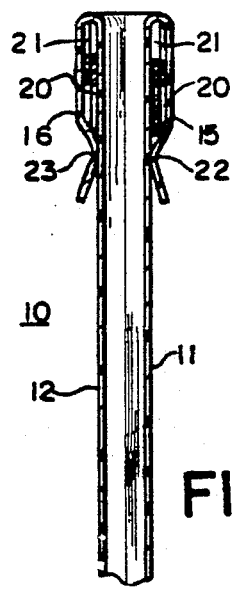
FIG. 2 is a sectional view taken along the lines 2—2 in FIG. 1.
Figure 3:
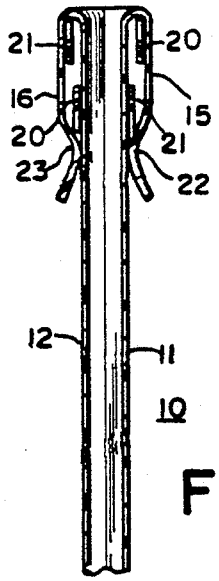
FIG. 3 is a sectional view taken along the lines 3—3 in FIG. 1.
Figure 4:
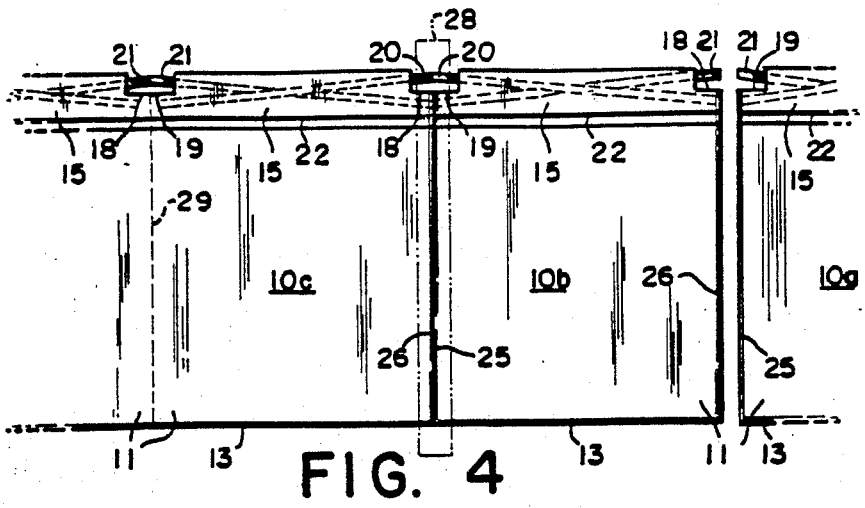
FIG. 4 is a view showing the method of manufacture of the dual draw tape bag illustrated in FIG. 1.
Figure 5:
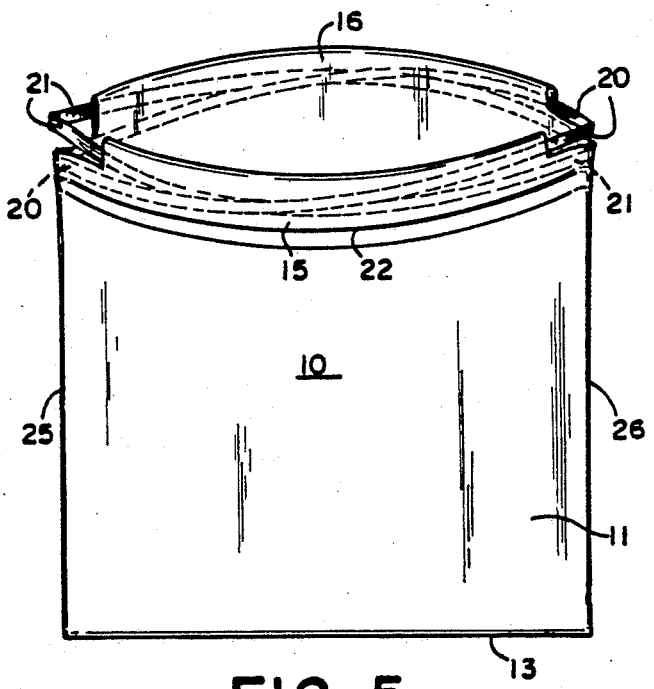
FIG. 5 is a perspective view of the dual draw tape bag illustrated in FIG. 1.

Referring to FIGS. 1–5 it will be seen that a draw tape bag 10 according to the present invention includes a front panel 11 and a rear panel 12. The two panels preferably are formed from a tube of polyethylene which is oriented in the direction of extrusion. The bottom 13 of the bag 10 may be formed by a fold or heat seal joining the front and back panels 11 and 12. The tube is slit along the top and the two longitudinal free edges are folded over respectively against the adjoining panels 11 and 12 to provide a pair of longitudinal hems 15 and 16 of double layer thickness opposite the longitudinal fold edge of bottom 13. As shown in FIGS. 1 and 5 the opposite ends of the hems 15 and 16 are provided with openings or holes 18 and 19. Each of the hems 15 or 16 is provided with a pair of crossed tapes 20 and 21. After the draw tapes 20 and 21 have been inserted in the respective hems 15 and 16, the double layer thickness of each hem is longitudinally joined together along seal lines 22 and 23 to form opposed tubular channels each containing a pair of the crossed draw tapes 20 and 21.

It will be noted that the tape 20 crosses over the tape 21 within their respective hems 15 and 16. One end of the draw tape 20 in hem 15 is below the hole 19 at one side of the bag 10 and the other end of draw tape 20 is in line with the hole 18 at the other side of the bag 10. One end of the second draw tape 21 o the pair in hem 15 is below the hole 18 at one side of the bag 10 and in line with the hole 19 at the other side of the bag 10. One of the ends of the draw tapes 20 are secured to one side of the bag 10 when the side heat seal 25 is made and one of the ends of the draw tapes 21 are secured to the opposite side of the bag 10 when the side heat seal 26 is made. The opposite or free ends of the draw tapes 20 are secured together when the side heat seal 26 is made to form a loop or annular draw tape and the opposite or free ends of the draw tapes 21 are secured together when the side heat seal 25 is made to form a loop or annular draw tape. It will be noted in FIG. 5 that the annular draw tape formed by tapes 20 passes through the annular draw tape formed by the tapes 21. Thus the draw tapes are crossed within the bag and are locked together like two links in a chain.

After the hems 15 and 16 have been heat sealed at 22 and 23 the flexible bag material and crossed tapes 20 and 21 are transversely sealed and severed at predetermined intervals, i.e. corresponding to bag width, along the length of the flexible bag material to separate individual bags from the continuous length of flexible thermoplastic bag material. As shown in FIG. 4 the leading bag **10*a* has been severed from the continuous length of flexible thermoplastic bag material and the next bag 10*b* in the line is being sealed and concurrently severed as indicated by the sealing/cutting member diagrammatically illustrated at 28. A suitable seal/cutter assembly 28 is well known in the art as disclosed in the aforesaid U.S. Pat. No. 4,624,654. As shown in FIG. 4 the side edges of the next bag 10*c* will be sealed and cut at the dotted line 29** from the continuous length of flexible thermoplastic bag material.

In a preferred method of forming dual tape bags in accordance with the present invention a continuous length of flexible thermoplastic bag material is folded once longitudinally to provide a longitudinal fold edge and two adjoining material layers each with a longitudinal free edge opposite the longitudinal fold edge. The two longitudinal free edges are respectively folded against the adjoining layers to provide a pair of longitudinal hems 15 and 16 of double layer thickness opposite the longitudinal fold edge. While the free edges have been folded against the outer surfaces of the panels 11 and 12, FIGS. 2 and 3, it is to be understood that they may be folded against the inner surfaces of these panels. As shown in FIG. 4 the openings or holes 18 and 19 at the opposite ends of the hems 15 in the bags **10*a*–10*c* are adjacent each other and thus both holes 18 and 19 for adjacent bags may be punched at the same time. The holes are punched at predetermined intervals corresponding to the width of the bags. After the hems have been formed a pair of continuous strip thermoplastic draw tapes 20 and 21 are inserted in crossed relation in each hem. The tapes 20 and 21 are oscillated up and down for alternate bags, as shown in FIG. 4 so that one end of one tape in the pair in one hem is below the hole at one side of the bag and in line with the hole at the other side of the bag and one end of the second tape in the pair is in line with the hole at the one end of the bag and below the hole at the other side of the bag. It will also be noted in FIGS. 1, 4 add 5 that the tape 20 crosses over the tape 21 in each of the hems 15 and 16. Thus when the tapes 20 and 21 have their respective ends heat sealed to form annular draw tapes they are locked together like two links in a chain and are crossed within the bag. After the pair of crossed draw tapes have been inserted in the hems the double layer thickness of each hem is joined together by a heat seal to form a channel along the longitudinal edge of each layer opposite the longitudinal fold. As shown in FIG. 4** the continous length of flexible thermoplastic bag material and crossed draw tapes are transversely sealed and severed at the predetermined intervals along the length of the flexible bag material to separate individual bags with crossed annular draw tapes from the continuous length of flexible bag material.

Draw tape bags produced according to the present invention have numerous advantages For example in some applications, such as food storage bags, it is necessary to have a tight closure. It is not possible to provide a tight closure in prior art bags where the hole for the draw tapes is at the center of the bag rather than at the ends. By utilizing two annular tapes crossed within the bag where the ends are pulled from the opposite sides of the bag, it is possible to squeeze the film together tightly and make a tight closure for the bag. By crossing the tapes, the tapes will squeeze the film directly.

What is claimed is:

1. A dual draw tape bag which comprises:

a front wall and a back wall of flexible sheet material joined to each other along the edges of the bag;

tubular channels extending along opposed transverse top edges of said front wall and said back wall, respectively, said channels defining an open mouth for the bag, each of said channels having openings at the opposite ends of said top edges of the bag; and a pair of tapes extending through each of said channels, one of the ends of each of said tapes being attached to the opposite side edges of the bag beneath the openings in said channels and the other ends of said tapes extending through the respective openings at the other ends of said channels so that the tapes in the channels cross whereby when the tapes are pulled, the top of the bag is drawn tightly together.

2. A dual draw tape bag according to claim 1 wherein the ends of said tapes extending through the respective openings are joined together to form a pair of annular draw tapes for closing the top of the bag.

3. A dual draw tape bag according to claim 2 wherein said pair of annular draw tapes are interlocked.

4. A dual draw tape bag according to claim 2 wherein said flexible sheet material and said tapes comprise thermoplastic film wherein the side edges of the bag and the ends of the tapes are joined together by heat seals.

5. A method of forming a dual draw tape bag comprising the steps of:

providing a continuous length of flexible thermoplastic bag material folded once longitudinally and having a longitudinal fold edge and two adjoining material layers each with a longitudinal free edge opposite the longitudinal fold edge to form a front wall and a back wall of the bag;

folding the two longitudinal free edges respectively against said adjoining layers to provide a pair of longitudinal hems of double layer thickness opposite said longitudinal fold edge;

providing a hole in each hem at predetermined intervals corresponding to the width of the bags to expose subsequently inserted draw tape;

inserting a pair of continuous strip thermoplastic draw tapes in crossed relation into each hem, said tapes being oscillated up and down for alternate bags so that the end of one tape in the hem is below the hole at one side of the bag and in line with the hole at the other side of the bag and one end of the second tape in the pair is in line with the hole at the one side of the bag and below the hole at the other side of the bag;

longitudinally joining together the double layer thickness of each hem to form a tubular channel along the longitudinal top edges of the front wall and the back wall opposite the longitudinal fold, each channel containing a pair of continuous crossed draw tapes; and transversely sealing and severing the flexible bag material and crossed draw tapes at the predetermined intervals along the length of the flexible bag material to separate individual dual draw tape bags from the continuous length of flexible thermoplastic bag material.

6. A method according to claim 5 wherein the pair of continuous strip thermoplastic draw tapes inserted in crossed relation into each hem is positioned so that one tape of each pair crosses over the other tape of the respective pair whereby when the pairs of crossed draw tapes are sealed and severed they form interlocking annular draw tapes.

* * * * *